US006886974B1

(12) United States Patent
Millan et al.

(10) Patent No.: US 6,886,974 B1
(45) Date of Patent: May 3, 2005

(54) SYSTEM FOR FLUID AGITATION

(75) Inventors: Jorge A. Millan, Lawndale, CA (US); Glen S. Abad, Placentia, CA (US); Arnold J. Comproni, Sylmar, CA (US); John P. Inks, Fullerton, CA (US)

(73) Assignee: Northrop Grumman Corporation, Los Angeles, CA (US)

( * ) Notice: Subject to any disclaimer, the term of this patent is extended or adjusted under 35 U.S.C. 154(b) by 154 days.

(21) Appl. No.: 10/162,805

(22) Filed: Jun. 4, 2002

(51) Int. Cl.[7] ..... B01F 7/20

(52) U.S. Cl. ..... 366/191; 366/249; 366/312; 366/325.93; 366/605; 239/142; 239/DIG. 14

(58) Field of Search ..... 366/52, 67, 191, 366/247, 249–252, 309, 312, 325.92, 325.93, 366/605; 239/142, DIG. 14

(56) References Cited

U.S. PATENT DOCUMENTS

| | | | | | |
|---|---|---|---|---|---|
| 2,034,685 | A | * | 3/1936 | Langer | 23/304 |
| 3,025,006 | A | | 3/1962 | Maurath | |
| 3,203,631 | A | * | 8/1965 | Jutila | 239/124 |
| 3,212,759 | A | * | 10/1965 | Brown | 366/11 |
| 3,249,342 | A | | 5/1966 | Mikkelsen | |
| 3,362,690 | A | * | 1/1968 | McSwain | 366/102 |
| 3,841,530 | A | * | 10/1974 | Janninck | 222/189.04 |
| 4,095,307 | A | * | 6/1978 | Brubaker | 15/246.5 |
| 4,179,904 | A | * | 12/1979 | McClenny | 62/342 |
| 4,515,483 | A | * | 5/1985 | Muller et al. | 366/303 |
| 4,983,046 | A | * | 1/1991 | Murata et al. | 366/312 |
| 4,993,593 | A | | 2/1991 | Fabiano et al. | 222/1 |
| 5,009,510 | A | * | 4/1991 | Gabriele | 366/311 |
| 5,249,861 | A | * | 10/1993 | Thomson | 366/194 |
| 5,261,745 | A | | 11/1993 | Watkins | 366/250 |
| 5,288,028 | A | | 2/1994 | Spivak | 239/683 |
| 5,344,232 | A | * | 9/1994 | Nelson et al. | 366/139 |
| 5,630,666 | A | | 5/1997 | Rodriguez | 366/192 |

* cited by examiner

*Primary Examiner*—David Sorkin
(74) *Attorney, Agent, or Firm*—Fulbright & Jaworski LLP

(57) ABSTRACT

According to one embodiment of the invention, a system for mixing particles in fluid is provided. The system includes a container defining a chamber. The chamber has a narrowing region and is operable to be pressurized. The system also includes an agitator that has one or more flexible edges positioned in contact with the surface of the narrowing region. The agitator is operable to sweep the surface of narrowing region using the one or more flexible edges to agitate the particles. The system also includes an opening that is positioned at the narrowing region.

6 Claims, 3 Drawing Sheets

SYSTEM FOR FLUID AGITATION

TECHNICAL FIELD OF THE INVENTION

This invention relates generally to mixers and more particularly to a fluid agitator.

BACKGROUND OF THE INVENTION

Different types of fluid may be used to apply particles of material to a device or a structure. For example, paint is a medium that may be used to apply metallic particles to an automobile for a glittering appearance. In such applications, even distribution of particles throughout the fluid is desirable so that particles are evenly applied to the surface of the device or structure.

However, particles generally tend to settle or collect in particular areas of the container that holds the fluid mixture. This problem is known as "particle entrapment." Particle entrapment results in uneven distribution of particles in the fluid. Furthermore, particle entrapment causes waste of the particles because entrapped particles are not likely to be drawn from the container for application. As such, it is necessary to agitate the fluid mixture so that the particles remain evenly distributed throughout the fluid while avoiding particle entrapment. Proper agitation of fluid and prevention of particle entrapment may be critical in applying specialty coating on some military aircraft.

SUMMARY OF THE INVENTION

According to one embodiment of the invention, a system for mixing particles in fluid is provided. The system includes a container defining a chamber. The chamber has a narrowing region and is operable to be pressurized. The system also includes an agitator that has one or more flexible edges positioned in contact with the surface of the narrowing region. The agitator is operable to sweep the surface of narrowing region using the one or more flexible edges to agitate the particles. The system also includes an opening that is positioned at the narrowing region.

According to one embodiment of the invention, a method for agitating fluid having particles in a reservoir of a vessel is provided. The method includes channeling the fluid into the reservoir. The method also includes sweeping the surface of the reservoir to agitate the fluid. The method also includes accessing the agitated fluid from the reservoir.

Some embodiments of the invention provide numerous technical advantages. Some embodiments may benefit from some, none, or all of these advantages. For example, according to one embodiment of the invention, particles are evenly distributed in the fluid while reducing particle entrapment by sweeping the areas that are prone to particle entrapment. According to another embodiment of the invention, waste of fluid mixture is reduced by channeling the fluid mixture to an outlet. According to another invention, agitation efficiency is increased by agitating the fluid mixture in an area where the fluid mixture is channeled. The design and manufacture of some embodiments of the invention are simplified by the elimination of complex profiles. According to another embodiment of the invention, the maintenance of the container and agitator is simplified by the removable edge of the agitator, the sloped walls of the aperture in the agitator, and the removable shaft.

Other technical advantages may be readily ascertained by one of skill in the art.

BRIEF DESCRIPTION OF THE DRAWINGS

Reference is now made to the following description taken in conjunction with the accompanying drawings, wherein like reference numbers represent like parts, in which.

DETAILED DESCRIPTION OF EXAMPLE EMBODIMENTS OF THE INVENTION

Embodiments of the invention are best understood by referring to FIGS. 1 through 5B of the drawings, like numerals being used for like and corresponding parts of the various drawings.

Figure 1:
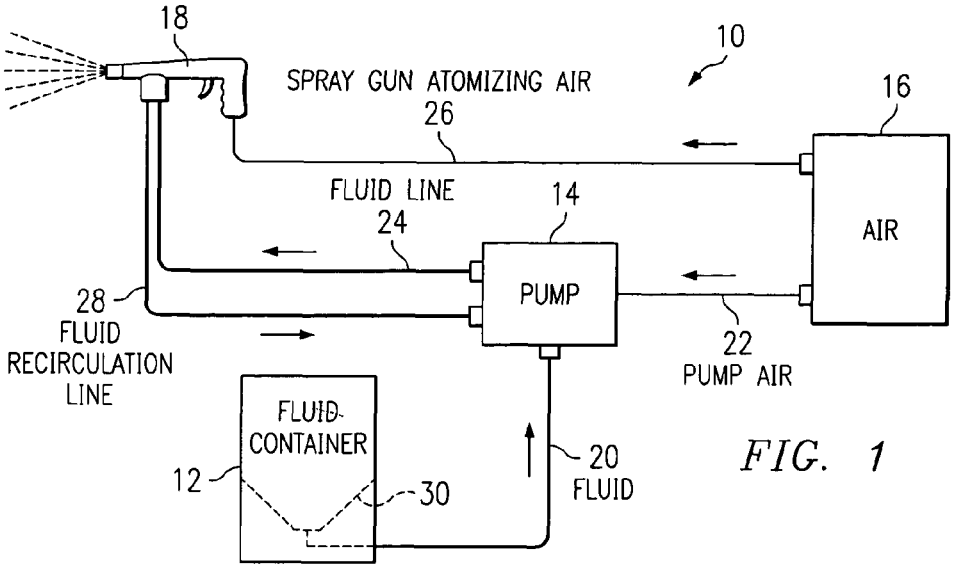
FIG. 1 is a schematic diagram illustrating an embodiment of a fluid application system.

FIG. 1 is a schematic diagram showing an embodiment of a fluid application system 10 that may benefit from the teachings of the present invention. Application system 10 includes a fluid container 12 having a narrowing bottom 30, a pump 14, an air source 16, and an applicator 18. Fluid container 12 is coupled to pump 14 by a fluid line 20. Pump 14 is coupled to air source 16 by a pump air line 22. Pump 14 is also coupled to applicator 18 by a fluid line 24 and a fluid recirculation line 28. Air source 16 is coupled to applicator 18 by an applicator air line 26.

Lines 20, 22, 24, 26 and 28 may be any lines that are operable to carry fluids or fluid mixtures, including gas or liquid mixed with solid particles. An example is paint for automobile having metallic flakes. Applicator 18 may be any device for applying the fluid, such as a spray gun, as shown in FIG. 1. Applicator 18 is referred to herein as spray gun 18. However, other applicators may be used depending on the nature of the particular application. Air source 16 may be any device that is operable to provide air, such as an air compressor.

In operation, a fluid or a fluid mixture having particles is taken from fluid container 12 and sent to pump 14 over fluid line 20. Pump 14 then pumps the fluid mixture to spray gun 18 over fluid line 24. Pump 14 receives its required air from air source 16 over pump air line 22. In one embodiment, air source 16 supplies air to spray gun 18 over line 26, so that spray gun 18 may use the air to atomize the fluid mixture that spray gun 18 receives from pump 14 over fluid line 24. Any unused fluid mixture in spray gun 18 is returned to pump 14 over fluid recirculation line 28, in one embodiment of the invention. In some embodiments, unused fluid mixture from spray gun 18 may be returned to fluid container 12 over a separate line (not explicitly shown). Returning unused fluid mixture from spray gun 18 to pump 14 rather than to fluid container 12 is advantageous in some embodiments of the invention because the increased temperature of the unused fluid mixture from spray gun 18 does not affect the temperature of the fluid mixture at the source (i.e. the fluid mixture in the fluid container.) This may be important if the temperature of the fluid mixture must be maintained at a certain level due to its chemical properties.

System 10 may be used to apply various types of fluids or fluids having particles, such as specialty coating for combat aircraft or metallic paint for automobiles. Paint with metallic particles will be used as an example fluid having particles (referred to herein as "fluid mixture" or "paint mixture.") However, it should be understood that other fluids having different materials may be used in conjunction with system 10. For example, system 10 may be used to apply paint having metallic flakes for automobiles.

Particles mixed with paint tend to settle to the bottom because the density of the particle is generally greater than the density of the fluid. Although there are agitators currently in the market to agitate the paint mixture, the shape of the container and the way in which the agitator mixes the paint cause certain areas of the container to be packed with the settled particles. This is referred to as "particle entrapment." For example, a container having a flat bottom and an agitator that is suspended within the container may not adequately prevent the particles from being deposited at the bottom surface and in the corners where the wall of the container and the bottom of the container are joined. In certain cases, the agitator may cause further particle entrapment or aggravate the existing particle entrapments by driving the particles to a certain area. As such, the mixing of particles and the paint may be inefficient. Furthermore, conventional paint containers and their accompanying agitators may cause waste of fluid mixture, which may be intolerable when the paint or particles are extremely expensive. In addition, the existing agitators may have certain areas that may also be prone to particle entrapment, which may be expensive both in terms of waste of paint and particles, the efficiency of agitation, and the maintenance of the agitation assembly.

According to the teachings of the invention, a method and system are provided that agitate the fluid mixture by sweeping the surface where particle entrapment is likely to occur. This is advantageous because particles do not have the opportunity to settle to the particular area and cause particle entrapment. Preventing particle entrapment increases the efficiency of mixing of the particles and the paint while reducing paint waste and particle waste. Additional details of example embodiments of the system and method are described in greater detail below in conjunction with portions of FIG. 1 and FIGS. 2 through 5B.

Referring again to FIG. 1, in one embodiment of the invention, the particles in fluid mixture contained in fluid container 12 are channeled to a designated area. The term "channeled" refers to directing or urging the fluid mixture to a particular area or direction. In one embodiment, the narrowing shape of bottom 30 may channel the particles to a region close to the bottom of container 12. The term "narrowing" refers to a structural feature having a decreasing cross-sectional distance. One example of a narrowing structure is a cone, where the diameter of the cone decreases as it reaches the tip of the cone. However, other structures or shapes may be used to channel the paint and particles, as described in greater detail below. In one embodiment, paint agitation occurs where the paint and the particles are channeled (not explicitly shown in FIG. 1.) Particles are swept along the surface of narrowing bottom 30 so that particle entrapment may be prevented (not explicitly shown in FIG. 1). Some embodiments of structures that may be used for the agitation and sweeping of the channeled paint and particles are described below.

Figure 2:
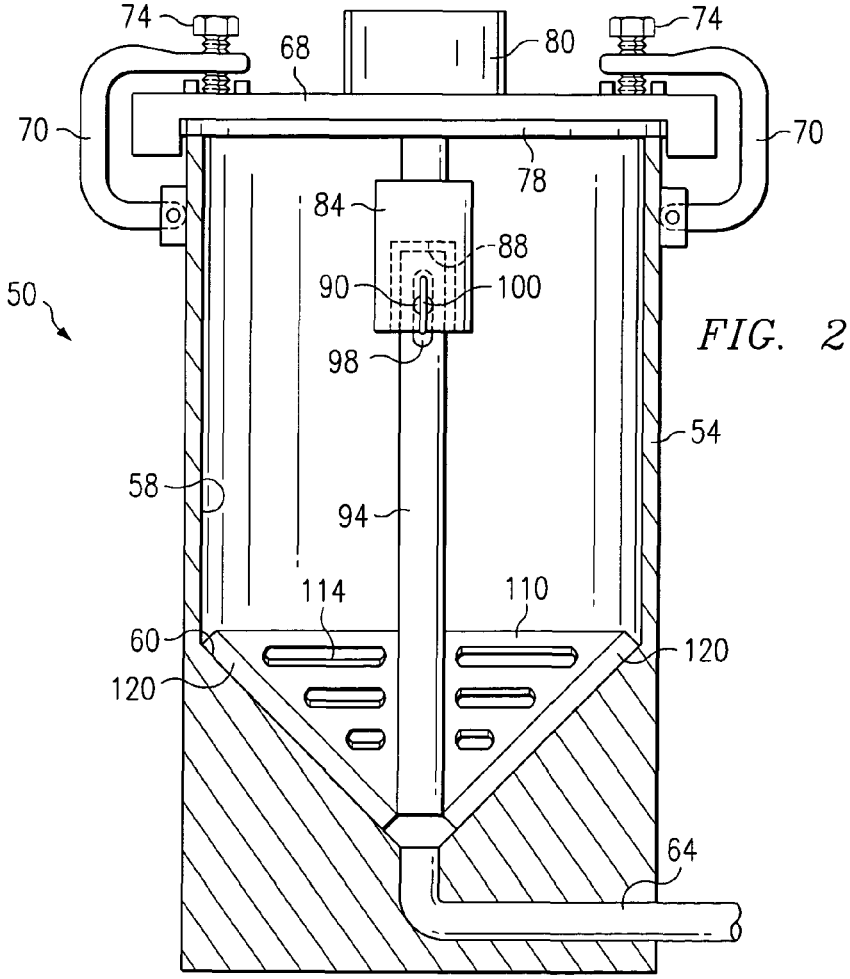
FIG. 2 is a front sectional view of an embodiment of a fluid container shown in FIG. 1.

FIG. 2 is a front sectional view of one embodiment of a paint container 50 that may be used in conjunction with system 10 of FIG. 1. Container 50 includes a container body 54 that defines a chamber 58, a bottom 60, an opening 64, and a cover 68. In one embodiment, clamp arms 70 may be used in conjunction with fasteners 74 to secure cover 68 over container 50. However, other methods of securing cover 68 to container 50 may be used, as well known by a skilled artisan. In one embodiment, a gasket 78 may be used between cover 68 and container 50 to achieve a seal so that pressure within chamber 58 may be controlled. A motor 80 is coupled to cover 68. Motor 80 is also coupled to a shaft receiver 84 having a cavity 88 and a pinhole 90. A shaft 94 having a guide 98 is received by cavity 88 and coupled to shaft receiver 84 by a pin 100 that engages shaft 94 through pinhole 90 and guide 98. Cavity 88, pinhole 90, guide 98, and pin 100 are more clearly depicted in FIG. 3. Agitator 110 is coupled to the other end of shaft 94. Agitator 110 comprises apertures 114 and edges 120.

In some embodiments of the invention, parts of container 50, such as body 54, bottom 60, cover 68, clamp arm 70, shaft receiver 84, shaft 94, pin 100, and agitator 110, may be manufactured using stainless steel. Using stainless steel is advantageous because stainless steel is sturdy, chemically stable in a wide range of pressure, and does not rust. However, depending on the particular circumstances for which container 50 may be used, one skilled in the art may choose other materials to manufacture container 50. For example, where container 50 is not pressurized or certain chemicals are not used in fluid mixture, aluminum may be an alternative material for building container 50.

In one embodiment, container 54 may have a cylindrical shape; however, container 54 may have any shape as determined by one skilled in the art. In one embodiment, chamber 58 narrows as it reaches its bottom 60. One example of such a feature is shown as bottom 60. In one embodiment, bottom 60 has a conical shape. Narrowing bottom 60 may channel fluid and any particles mixed in the fluid that may settle to the bottom of chamber 58. However, the narrowing bottom 60 is not limited to a conical shape; for example, bottom 60 may narrow in the shape of a hemisphere. The shape of a particular narrowing bottom 60 is of minor significance, as long as the shape is such that the fluid and particles are channeled to a desired area. Other methods of channeling fluid mixture to a particular area may be used by one skilled in the art.

In the embodiment shown in FIG. 2, guide 98 is used in conjunction with pin 100 to allow up and down movement of shaft 94. However, in other embodiments of the invention, such structures may not be necessary. In some embodiments of the invention, a spring may be placed between shaft receiver 84 and the end of shaft 94 to allow resisted up and down movement of shaft 94. Other ways of allowing up and down movement of shaft 94 may be used as well known by one skilled in the art.

Agitator 110 has a generally flat profile with a certain thickness, and positioned so that edges 120 coupled to agitator 110 make physical contact with bottom 60. In some embodiments of the invention, a flexible and chemically stable material may be used as edges 120. An example of such a material is Teflon. In one embodiment of the invention, edges 120 may be removable so that worn out edges 120 may be replaced by new edges 120. Apertures 114 of agitator 110 may be distributed throughout the body of agitator 110 in any pattern and assume any shape. In the embodiment shown in FIG. 2, aperture 114 is a slot with rounded sides. In some embodiments of the invention, apertures 114 are milled at an angle. Additional details of aperture 114 are described in conjunction with FIGS. 4A through 4B. In some embodiments, agitator 110 may have a shape that is similar to the cross-sectional shape of bottom 60. In the embodiment shown in FIG. 2, agitator 110 has a triangular shape because conical bottom 60 has a triangular cross-sectional shape. However, agitator 110 is not necessarily limited to the cross-sectional shape of bottom 60. Agitator 110 may have any shape so long as the shape allows the length of edge 120 to make physical contact with an area that is designated to be swept. In the embodiment shown in FIG. 2, the fact that bottom 60 has a triangular cross-section allows the use of straight edges 120 for sweeping. This is advantageous because designing and manufacturing edges 120 having a straight line profile is simpler and more cost effective.

Opening 64 may be positioned at the center of narrowing bottom 60 (as shown in FIG. 2). This is advantageous in some embodiments of the invention because paint and particles may naturally drain towards opening 64, due to the sloped sides of narrowing bottom 60. This reduces the amount of residual paint or particles in container 50. However, opening 64 may be positioned at a different location that allows access to the fluid mixture from an area defined at least partially by conical bottom 60. For example, opening 64 may be positioned along the sides of narrowing bottom 60. There may be more than one opening 64 in other embodiments of the invention. In another embodiment of the invention, opening 64 may be positioned at the bottom tip of shaft 94 and run along the length of shaft 94. The precise location of opening 64 may vary, as long as opening 64 allows access to the agitated paint within chamber 58.

In operation, paint with particles are placed in chamber 58. Cover 68, clamp arms 70, and fasteners 74 are used to cover chamber 58. In one embodiment of the invention, pressure within chamber 58 is increased compared to the pressure outside of chamber 58. In another embodiment, pressure within chamber 58 is maintained at a constant level regardless of the pressure outside of chamber 58. Such control of pressure within chamber 58 is referred to as "pressurized." If the pressure in chamber 58 does not need to be controlled, then cover 68 may not be necessary, in some embodiments. Particles in fluid mixture (not explicitly shown) are channeled to a particular area of container 50 by the shape of bottom 60. In one embodiment, the narrowing shape of bottom 60 channels particles to a region of container 50 where particles are likely to settle. In the embodiment shown in FIG. 2, the region is partially defined by bottom 60. In some embodiments of the invention, agitator 110 is positioned in that region. Motor 80 rotates agitator 110 that is in contact with the surface of bottom 60 by delivering torque through shaft receiver 84 and shaft 94. The rotation causes agitator 110 to sweep the surface of narrowing bottom 60 using edges 120. The term "sweep" refers to clearing a surface using a structure that is in physical contact with the surface. Any particles that are settling or have settled onto narrowing bottom 60 may be swept by edges 120 and distributed evenly throughout the paint. In one embodiment, particles in paint move through apertures 114 due to the rotation of agitator 110. Such passing of paint and particles through apertures 114 facilitates the distribution of particles throughout the paint. In one embodiment, the paint with evenly distributed particles are drawn through opening 64 and delivered to pump 14, shown in FIG. 1.

In one embodiment, agitator 110 spins in one direction only. In another embodiment, agitator 110 may alternate between spinning in one direction then to the opposite direction. The direction of rotation of agitator 110 is of minor significance, so long as the movement of agitator 110 allows edges 120 to sweep some portion of narrowing bottom 60.

In one embodiment, as shown in FIG. 2, shaft 94 is coupled to shaft receiver 84 in a way that allows up and down movement of shaft 94. Such coupling allows agitator 110 to ride over any surface irregularities of narrowing bottom 60 that may have been caused by stubborn particle entrapment or surface imperfections of the swept surface. This is advantageous because the probability of damage to narrowing bottom 60, agitator 110, and edges 120 is reduced. Furthermore, this extends the life of edges 120 and removes any existing particle entrapments by erosion rather than by loosening chunks of clumped particles.

The combination of channeling the paint particles to one area of chamber 58 and sweeping the surface associated with that designated area is advantageous because it evenly distributes the particles throughout the paint while preventing particle entrapment. The fluid, now having evenly distributed particles, may be drawn through opening 64 for application. In some embodiments, positioning opening 64 at the tip of narrowing bottom 60 is advantageous because paint/particles are likely to drain through opening 64 due to the sloped surface of narrowing bottom 60. This reduces residual fluid mixture in container 50. Allowing the up and down movement of agitator 110 also extends the life of container 50 by allowing agitator 110 to ride over any stubborn surface irregularities of the swept surface, which lowers the probability of damage to the swept surface and the agitator. Using flexible and chemically stable edges 120 allows agitator 110 to sweep a surface without causing a chemical reaction with the fluid mixture or damage to the surface or the agitator. Furthermore, the sweeping is made more efficient because the flexibility of edges 120 forms a more complete barrier with the swept surface.

Figure 3:
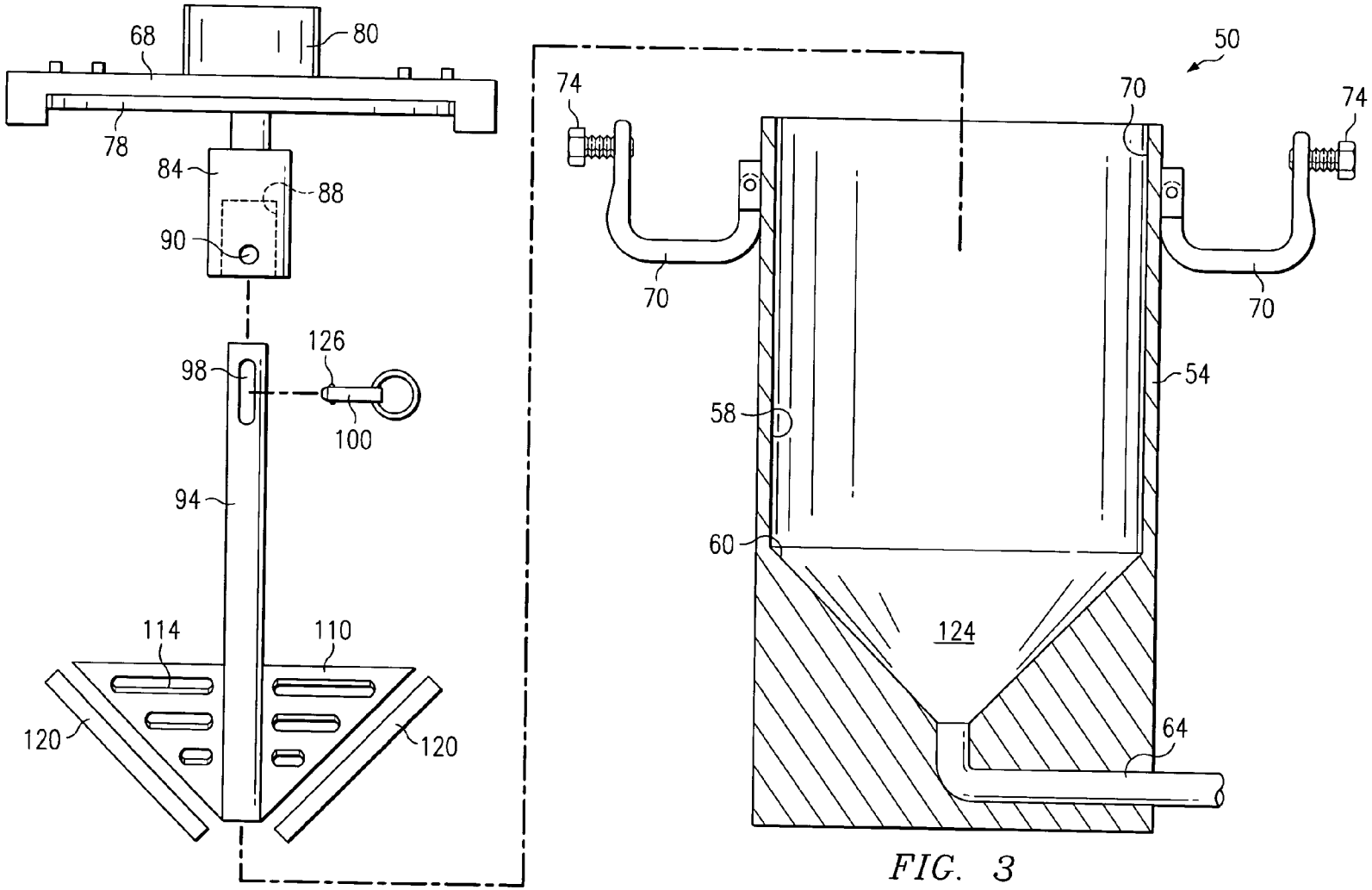
FIG. 3 is a front sectional view illustrating embodiments of the various parts of the fluid container shown in FIG. 2.

FIG. 3 is a front sectional view illustrating additional details of an embodiment of container 50 shown in FIG. 2, showing selected portions of container 50. Cavity 88 of shaft receiver 84 receives shaft 94. Pinhole 90 is aligned with guide 98. Pin 100 is inserted through both pinhole 90 and guide 98. Pin 100 may be secured using any suitable method. For example, in the embodiment shown in FIG. 3, pin 100 has a spring-loaded expander 126 at the tip of pin 100. Expander 126 is compressed as pin 100 is inserted from one side through pinhole 90 and guide 98 and then expands on the other side after passing through pinhole 90 and guide 98. Using pin 100 to couple shaft 94 to motor 80 is advantageous because the ease of the removal of shaft 94 and agitator 110 simplifies the maintenance and cleaning of agitator 110 and shaft 94.

In one embodiment of the invention, edges 120 are removable from agitator 110. This is advantageous because having edges 120 that are removable simplifies the replacement of worn out edges with new edges. In the embodiment shown in FIG. 3, narrowing bottom 60 defines a reservoir 124. Reservoir 124 is an area where paint or particles may be channeled and from which well-agitated paint having evenly distributed particles may be drawn for application. Depending on the configuration of container 50, reservoir 124 may be located in different locations of container 50 and have different shapes. For example, reservoir 124 may be taller if the walls of narrowing bottom 60 had a steeper angle. In another embodiment, reservoir 124 may simply be a certain area where the probability of even particle distribution is higher than other areas of container 50.

Figure 4A:
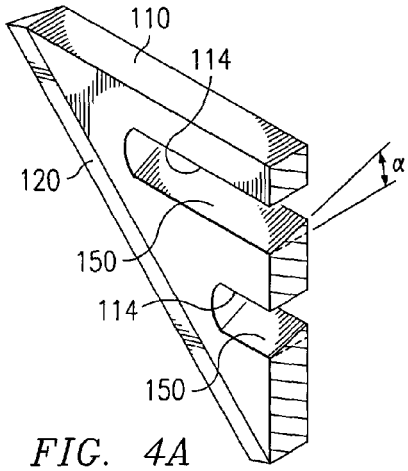
FIG. 4A is a perspective cross-sectional view illustrating an embodiment of an agitator shown in FIGS. 2 and 3.

FIG. 4A is a perspective cross-sectional view illustrating additional details of an embodiment of apertures 114 that are positioned on the body of agitator 110. In some embodiments of the invention, apertures 114 are milled at an angle. For example, as shown in FIG. 4A, a bottom 150 of aperture 114 is sloped at an angle. This is advantageous because sloped bottom 150 allows paint or particles to run off of sloped bottom 150 and avoid any particle entrapment on the inner walls of aperture 114.

Figure 4B:
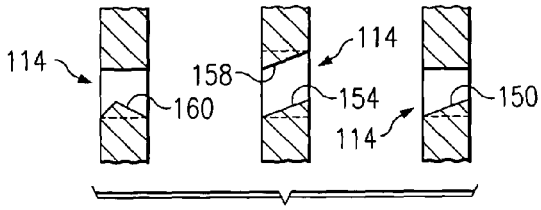
FIG. 4B is a side cross-sectional view illustrating various embodiments of an aperture of the agitator shown in FIGS. 2 through 4A.

FIG. 4B is a side cross-sectional view of agitator 110 having apertures 114. As shown in FIG. 4B, apertures 114 may include inner walls having different slopes. For example, aperture 114 may have a single sloped bottom 150. Aperture 114 may have a sloped bottom 154 and a sloped top 158. Aperture 114 may also have a knife-edge bottom 160. In some embodiments of the invention, inner walls of aperture 114 may be in any shape or combination of shapes so long as the shape allows any fluid mixture to run off the walls that define aperture 114.

Figure 5B:
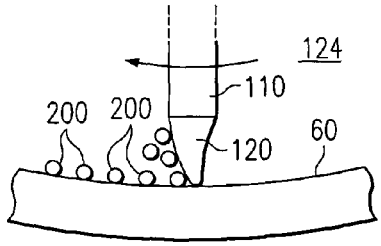
FIG. 5B is a top view illustrating an embodiment of an edge of the agitator shown in FIG. 2.
Figure 5A:
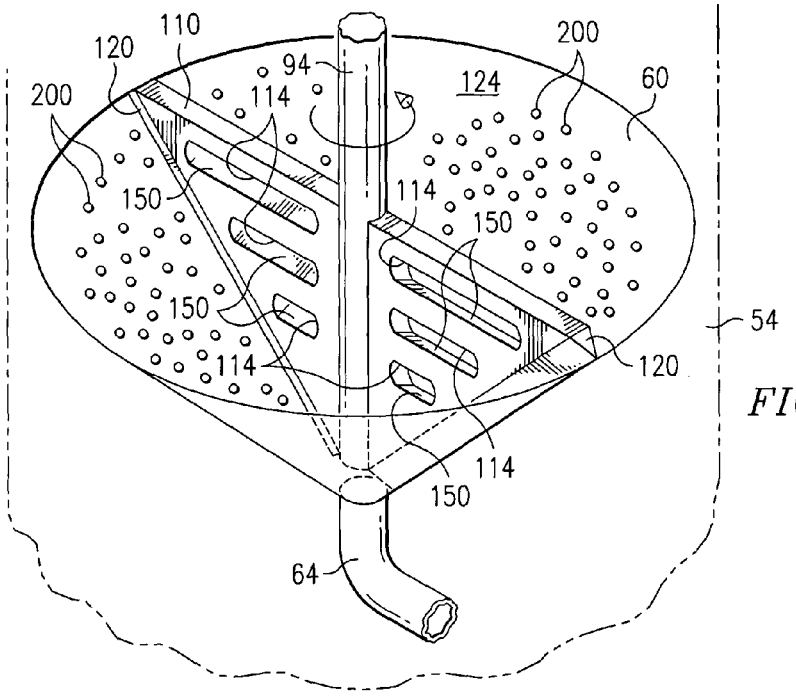
FIG. 5A is a perspective view of the agitator and one area of the container shown in FIG. 2.

FIG. 5A is a perspective view of agitator 110 operating in conjunction with bottom 60. In the embodiment shown in FIG. 5A, the side profile of agitator 110 is such that the side profile matches the cross-sectional profile of conical bottom 60. Thus, as shaft 94 rotates agitator 110 within reservoir 124, edges 120 sweep across the surface of narrowing bottom 60 to sweep particles 200 that may have settled onto the surface of bottom 60. In one embodiment, as particles 200 are swept, some of the paint and particles 200 are run through aperture 114 due to the rotational movement of agitator 110. In one embodiment, paint and particles 200 run off sloped bottom 150 of apertures 114.

FIG. 5B is a top view of agitator 110 sweeping the surface of bottom 60 within reservoir 124. As shown in FIG. 5B, edge 120 is positioned against the surface of narrowing bottom 60 and is dragged along the surface of narrowing bottom 60 to sweep particles 200. Although the cross-sectional profile of edge 200 is shown as a triangular shape, edge 200 may have other cross-sectional shapes. For example, edge 200 may have a round cross-section, such as a circle or a semicircle.

Methods and systems described in detail above offers a solution to mixing particles and fluids. One benefit from some embodiments of the invention is that particles are evenly distributed throughout the fluid that is being drawn for application. Another benefit from some embodiments of the invention is that the probability of particle entrapment in certain areas of the fluid container is lowered. Another benefit from some embodiments of the invention is that residual paint and particles are reduced, which lowers fluid mixture waste. Another benefit from some embodiments of the invention is that the components of the fluid container are easily removable, which simplifies the maintenance and cleaning of the fluid container and agitator assembly. Another benefit from some embodiments of the invention is that the flexibility of the edges of the agitator allows a more efficient sweep of the swept surface. Another benefit from some embodiments of the invention is that the worn out edges of agitator may be replaced with new edges. Not all embodiments of the invention benefit from these advantages. Some embodiments may benefit some, none, or all of these advantages.

Although the present invention has been described in detail, it should be understood that various changes, substitutions, and alterations can be made hereto without departing from the spirit and scope of the invention as defined by the appended claims.

What is claimed is:

1. A system for agitating paint having particles, comprising:

a container defining a first surface region and a second surface region that are angled toward an outlet, the first surface region positioned symmetrically opposite from the second surface region;

a top cover positioned over the container and opposite from the outlet;

a motor coupled to the top cover;

a shaft having a first end and a second end, the first end slidably coupled to the motor;

an agitator coupled to the second end of the shaft, the agitator comprising a body having a plurality of apertures, a first edge, and a second edge, the first edge in contact with the first surface region and the second edge in contact with the second surface region, wherein each aperture comprises a sloped inner wall;

a tube having a first open end and a second open end, the first open end coupled to the outlet;

a pump coupled to the second open end of the tube; and a spray device coupled to the pump.

2. The system of claim 1 wherein said first edge or said second edge are flexible.

3. The system of claim 1 wherein said first edge or said second edge are removable from the agitator.

4. The system of claim 1 wherein said container includes a substantially cylindrical portion.

5. The system of claim 1 wherein said container includes a substantially conical portion.

6. The system of claim 1 wherein said container is formed from stainless steel.

* * * * *